United States Patent [19]

Tenhover et al.

[11] Patent Number: 4,537,625

[45] Date of Patent: Aug. 27, 1985

[54] AMORPHOUS METAL ALLOY POWDERS AND SYNTHESIS OF SAME BY SOLID STATE CHEMICAL REDUCTION REACTIONS

[75] Inventors: Michael A. Tenhover; Richard S. Henderson; Joseph R. Fox, all of Solon, Ohio

[73] Assignee: The Standard Oil Company (Ohio), Cleveland, Ohio

[21] Appl. No.: 588,014

[22] Filed: Mar. 9, 1984

[51] Int. Cl.[3] ..... B22F 3/24; B22F 9/00

[52] U.S. Cl. ..... 75/0.5 A; 75/0.5 B; 75/251; 148/11.5 P; 148/403

[58] Field of Search ..... 148/403; 75/0.5 A, 0.5 AA, 75/0.5 B, 0.5 BA, 0.5 C, 251

[56] References Cited

U.S. PATENT DOCUMENTS 4,067,732 1/1978 Ray ..... 148/403

4,318,738 3/1982 Masumoto et al. ..... 148/403

OTHER PUBLICATIONS

ASM Publication; *Metallic Glasses* (Papers Presented in 1976), Publication Date-1978; pp. 12 & 13, 32 & 33.

*Primary Examiner*—Wayland Stallard

*Attorney, Agent, or Firm*—Thomas P. Schur; Joseph G. Curatolo; Larry W. Evans

[57] ABSTRACT

Amorphous metal alloy powders may be synthesized by solid state reactions. Precursor components that include the elements of the amorphous alloy are chemically reduced to yield an intimate mixture. The resultant intimate mixture, as obtained or after heat-treating, exhibits amorphous characteristics. These powders are suitable for forming solid amorphous shapes.

41 Claims, No Drawings

AMORPHOUS METAL ALLOY POWDERS AND SYNTHESIS OF SAME BY SOLID STATE CHEMICAL REDUCTION REACTIONS

FIELD OF THE INVENTION

This invention relates to amorphous metal alloy powders and the novel preparation of such powders by solid state reactions. More specifically, this invention relates to the synthesis of amorphous metal alloy powders by the chemical reduction of metal-bearing compounds.

BACKGROUND OF THE INVENTION

Amorphous metal alloy materials have become of interest in recent years due to their unique combinations of mechanical, chemical and electrical properties that are especially well-suited for newly-emerging applications. Examples of amorphous metal material properties include the following:

uniform electronic structure,
compositionally variable properties,
high hardness and strength,
flexibility,
soft magnetic and ferroelectric properties,
very high resistance to corrosion and wear,
unusual alloy compositions, and
high resistance to radiation damage.

These characteristics are desirable for applications such as low temperature welding alloys, magnetic bubble memories, high field superconducting devices and soft magnetic materials for power transformer cores.

The unique combination of properties of amorphous metal alloy materials may be attributed to the disordered atomic structure of amorphous materials which ensures that the material is chemically homogeneous and free from the extended defects, such as dislocations and grain boundaries, that are known to limit the performance of crystalline materials. The amorphous state is characterized by a lack of long range periodicity, whereas a characteristic of the crystalline state is its long range periodicity.

Generally, the room temperature stability of amorphous materials depends on various kinetic barriers to the growth of crystal nuclei and to nucleation barriers that hinder the formation of stable crystal nuclei. Such barriers typically are present if the material to be made amorphous is first heated to a molten state then rapidly quenched or cooled through the crystal nucleation temperature range at a rate that is sufficiently fast to prevent significant nucleation to occur. Such cooling rates are on the order of $10^{6°}$ C./second. Rapid cooling dramatically increases the viscosity of the molten alloy and quickly decreases the length over which atoms can diffuse. This has the effect of preventing crystalline nuclei from forming and yields a metastable, or amorphous, phase.

Processes that provide such cooling rates include sputtering, vacuum evaporation, plasma spraying and direct quenching from the liquid state. It has been found that alloys produced by one method often cannot be similarly produced by another method even though the pathway to formation is in theory the same.

Direct quenching from the liquid state has found the greatest commercial success since a variety of alloys are known that can be manufactured by this technique in various forms such as thin films, ribbons and wires. U.S. Pat. No. 3,856,513 to Chen et al. describes novel metal alloy compositions obtained by direct quenching from the melt and includes a general discussion of this process. Chen et al. describes magnetic amorphous metal alloys formed by subjecting the alloy composition to rapid cooling from a temperature above its melting temperature. A stream of the molten metal is directed into the nip of rotating double rolls maintained at room temperature. The quenched metal, obtained in the form of a ribbon, was substantially amorphous as indicated by x-ray diffraction measurements, was ductile, and had a tensile strength of about 350,000 psi.

U.S. Pat. No. 4,036,638 to Ray et al. describes binary amorphous alloys of iron or cobalt and boron. The claimed amorphous alloys were formed by a vacuum melt-casting process wherein molten alloy was ejected through an orifice and against a rotating cylinder in a partial vacuum of about 100 millitorr. Such amorphous alloys were obtained as continuous ribbons and all exhibited high mechanical hardness and ductility.

The thicknesses of essentially all amorphous foils and ribbons formed by rapid cooling from the melt are limited by the rate of heat transfer through the material. Generally the thickness of such films is less than 50 $\mu$m. The few materials that can be prepared in this manner include those disclosed by Chen et al. and Ray et al.

Amorphous metal alloy materials prepared by electrodeposition processes have been reported by Lashmore and Weinroth in Plating and Surface Finishing, 72 (August 1982). These materials include Co-P, Ni-P, Co-Re and Co-W compositions. However, the as-formed alloys are inhomogeneous and so can be used in only limited applications.

The above-listed prior art processes for producing amorphous metal alloys depend upon controlling the kinetics of the solidification process; controlling the formation of the alloy from the liquid (molten) state or from the vapor state by rapidly removing heat energy during solidification. Most recently, an amorphous metal alloy composition as synthesized without resort to rapid heat removal. Yeh et al. reported that a metastable crystalline compound $Zr_3Rh$, in the form of a thin film, could be transformed into a thin-film, amorphous metal alloy by the controlled introduction of hydrogen gas; Applied Physics Letter 42(3), pp 242–244, Feb. 1, 1983. The amorphous metal alloy had an approximate composition of $Zr_3RhH_{5.5}$.

Yeh et al. specified three requirements as prerequisites for the formation of amorphous alloys by solid state reactions: at least a three component system, a large disparity in the atomic diffusion rates of two of the atomic species, and an absence of a polymorphic crystalline alternative as a final state. Thus, Yeh et al. teaches that solid state reactions would have limited applications for the synthesis of amorphous metal alloy materials.

The known amorphous metal alloys and processes for making such alloys discussed above suffer from the disadvantage that the so-formed amorphous alloy is produced in a limited form, that is, as a thin film such as a ribbon, wire or platelet. These limited shapes place severe restrictions on the applications for which amorphous metal materials may be used.

To produce bulk amorphous metal alloy objects the formed amorphous alloy must be mechanically reduced to a powder as by chipping, crushing, grinding and ball milling and then recombined in the desired shape. These are difficult processes when it is realized that most amorphous metal alloys have high mechanical strengths and also possess high hardnesses.

What is lacking in the area of amorphous metal alloy preparation is a simple process for the direct formation of a large variety of amorphous metal alloys. Especially lacking is a process that would synthesize amorphous metal alloy materials directly as powders suitable for forming bulk amorphous metal alloy shapes.

Hence, it is one object of the present invention to provide novel amorphous metal alloy compositions.

It is another object of the present invention to provide a process for the direct preparation of a large variety of homogeneous amorphous metal alloy compositions.

It is a further object of the present invention to provide a process for the direct preparation of a large variety of homogeneous amorphous metal alloy compositions in a powder form.

It is still another object of the present invention to provide a process for the direct preparation of a large variety of homogeneous amorphous metal alloy powders by solid state reactions.

These and additional objects of the present invention will become apparent in the description of the invention and examples that follow.

SUMMARY OF THE INVENTION

The present invention relates to a process for the synthesis of a substantially amorphous metal alloy comprising disposing at least one metal-bearing compound in a liquid medium and reducing the at least one metal-bearing compound so as to obtain a substantially amorphous metal alloy.

The invention also relates to a process for the synthesis of a substantially amorphous metal alloy comprising the steps of:

(a) disposing at least one metal-bearing compound in a liquid medium;

(b) reducing the at least one metal-bearing compound so as to obtain an intimate mixture of the components of the amorphous alloy to be synthesized; and (c) heat-treating the intimate mixture so as to form the substantially amorphous metal alloy.

The process disclosed herein provides for the synthesis of substantially amorphous metal alloy compositions as powders which may then be readily used to form bulk amorphous metal alloy shapes.

DETAILED DESCRIPTION OF THE INVENTION

In accordance with this invention, there are provided novel processes for the synthesis of substantially amorphous metal alloys. The term "substantially" as used herein with reference to the synthesized amorphous metal alloys means that the synthesized alloys described herein are at least fifty percent amorphous, preferably at least eighty percent amorphous and most preferably about one hundred percent amorphous, as indicated by x-ray diffraction analyses. The use of the phrase "amorphous metal alloys" as used herein refers to amorphous metal-containing alloys that may also comprise non-metallic elements. Amorphous metal alloys may include non-metallic elements such as boron, carbon, nitrogen, silicon, phosphorus, arsenic, germanium and antimony.

The precursor metal-bearing compounds suitable for use in this invention may include organometallic compounds such as monomers, dimers, trimers and polymers having metallo-organic ligands composed of saturated and/or unsaturated hydrocarbons, aromatic or heteroaromatic ligands, and may also include oxygen, boron, carbon, nitrogen, phosphorus, arsenic and/or silicon-containing ligands, and combinations thereof. Precursor metal-bearing compounds may also be halogen compounds, oxides, nitrates, nitrides, carbides, borides or metal-bearing salts. As disclosed earlier, precursor compounds may also be provided that do not contain a metal but which contribute a non-metallic element to the amorphous alloy composition. Precursor compounds may be sulfates, chlorides, bromides, iodides, fluorides, phosphates, hydroxides, perchlorates, carbonates, tetrafluoroborates, trifluoromethane sulfonates, hexafluorophosphates, sulfamate, or 2,4-pentanedionate.

Precursor compounds may exist at ambient temperatures as solids, liquids and gases. The solid state process as disclosed herein includes the step of disposing at least one metal-bearing compound in a liquid medium and reducing the at least one metal-bearing compound. Preferably the process comprises dissolving at least one metal-bearing compound in a solvent to form a solution and reducing the metal-bearing compound therefrom. When the metal-bearing compound in solution is reduced, a precipitate forms that is an intimate mixture of the components of the amorphous metal alloy to be synthesized. The liquid medium may be suitably chosen in view of the precursor metal-bearing compounds utilized in the particular reduction reaction. The liquid medium is preferably a solvent that may be aqueous or an alcohol such as methanol, ethanol, isopropyl alcohol and higher-molecular weight alcohols, or other organic solvents, or mixtures thereof. An additive may be disposed in the solvent to enhance the solution, such as in the formation of a micellular solution. More preferably the solvent is an aqueous solvent.

Reduction of the solution may be achieved by the addition of a reducing agent or by other reducing means such as electrochemical reduction and photocatalytic reduction. Examples of reducing agents that are suitable for use in this invention include hydrogen, hydrazine, hydroxyl amines, alkali borohydrides, alkali-hydrogen-phosphites and alkali hypophosphites. The reducing agent may contribute one or more elements to the alloy composition. As an example, when sodium borohydride is used as the reducing agent, boron from the sodium borohydride may be incorporated into the amorphous metal alloy composition.

The chemical reduction process may occur at any temperature below about the crystallization temperature of the amorphous metal alloy to be formed. Preferably the process occurs at about room temperature. If the chemical reduction occurs at an elevated temperature, the products of the reduction process may amorphously alloy concurrent with the reduction. If the reduction products are not amorphous, they may be made so by a subsequent heating step.

The chemical reduction of the precursor compounds preferably occurs in the absence of oxygen. This may be achieved by degassing the solution prior to addition of the reductant with nitrogen, an inert gas or a reducing gas such as hydrogen. Preferably the solution remains under an inert, reducing or reactive atmosphere. A reactive atmosphere refers to an atmosphere that may enhance the reduction process and/or contribute therefrom at least one component of the alloy composition. If some tolerance to oxygen is permitted in the desired amorphous metal alloy then an inert or reducing atmosphere may not be necessary.

This chemical reduction process yields a powder product comprising molecules containing the components of the desired amorphous metal alloy. The components are intimately mixed; the maximum size of the particles in the mixture preferably being from about 10 Angstroms to about 1000 Angstroms, and most preferably from about 10 Angstroms to about 500 Angstroms. These reduction products may be represented by the following empirical formula:

$$M_aX_{1-a}$$

wherein

M is at least one metal selected from the metals in Groups VI-B, VII-B, VIII, I-B, IIB and IIIB of the Periodic Table; and X is at least one element selected from Groups III-A, IV-A and V-A of the Periodic Table; and wherein a ranges from about 0.1 to about 0.9; and $$N_bY_{1-b}$$

wherein

N is at least one metal selected from the metals in Groups III-B, IV-B, V-B and VI-B of the Periodic Table; and Y is selected from the metals in Group VIII of the Periodic Table; and wherein b ranges from about 0.2 to about 0.8.

Under the proper circumstances, which is controlled by the process variables, the intimate mixture of alloy components that is formed by the chemical reduction will be substantially amorphous. This may occur, for example, when the chemical reduction process takes place at a temperature above ambient temperature, or when the alloy to be synthesized includes a highly reactive, diffusive component. Generally, however, the intimate mixture comprises a microcrystalline mixture of molecules containing the components of the amorphous metal alloy to be synthesized.

A subsequent heat-treating step at a temperature below the crystallization temperature of the amorphous metal alloy will decompose the molecules and allow diffusion of at least one metal component so as to convert the microcrystalline mixture to an amorphous metal alloy. Prior to the heat-treating step, the powder obtained from the decomposition of the precursor compounds may be pressed into a shape so that, upon heat-treating, a bulk amorphous metal alloy shape is obtained.

This heat-treating step is carried out under an atmosphere conducive to the formation of the amorphous metal alloy. This may occur under vacuum conditions, from about 0 torr. to about 500 torr., or in an inert, reducing or reactive atmosphere.

The synthesis of a homogeneous intimate mixture of the components of the alloy to be formed is critical for the production of the amorphous metal alloy. The chemical reduction of metal-bearing precursor compounds results in such a homogeneous intimate mixture. It has been observed that physical mixing of the same metal alloy components does not yield a mixture that, upon heat-treating, will synthesize an amorphous alloy.

The solid state reaction that occurs to alloy an intimate mixture of elements may be viewed by examining the free energy of the system. The intimate mixture of elements corresponds to a relatively high free energy of the system. At about room temperature such mixtures are kinetically restricted to this state. Adding energy to this system, during subsequent heat-treatments, allows the components to begin to inter-diffuse. The free energy of the system is lowered by an increase in the entropy of mixing and a decrease in the enthalpy due to the formation of heteropolar bonds. The absolute minimum in free energy in these systems will occur for the equilibrium crystalline alloys. For many alloy combinations, however, a local minimum in the free energy can exist in an amorphous phase. For alloy combinations such as these, the requirements for the formation of an amorphous phase by a solid state reaction are that the intimate mixture of components have a free energy higher than that of the amorphous phase and that the diffusion process to form the alloy be performed at temperatures sufficiently below the characteristic temperatures for the formation of crystalline nuclei.

In accordance with the above-described processes, there may be synthesized amorphous metal alloy compositions that are well-known in the prior art and have been synthesized by other processes, and, novel compositions that have not been synthesized by any prior art processes.

The above-described processes for synthesizing amorphous metal alloys are not hindered by the processing limitations of prior art processes. The methods disclosed herein do not depend on extremely high cooling rates or heat transfer properties, nor are high temperature or vacuum equipment necessary. Further, the processes of this invention provide for the production of intimate powder mixtures of the components of the desired amorphous metal alloy which powders may be pressed into desired shapes, and further heat-treated if necessary, to form solid amorphous alloy shapes. These bulk amorphous metal alloy shapes may find new and useful applications, since such shapes have not been conveniently or economically fabricated by other techniques.

EXAMPLES

The following examples are presented to more thoroughly demonstrate the present invention and are not intended, in any way, to be limitative thereof. Each of the following examples demonstrates the feasibility of utilizing the chemical reduction of precursor materials to produce an intimate mixture which comprises a substantially amorphous metal alloy powder, or which upon heat-treating, comprises a substantially amorphous metal alloy.

EXAMPLE 1

This Example illustrates the formation of a substantially amorphous iron-nickel-boron composition in accordance with a process taught herein above.

Equimolar amounts, of about 10 mmol, of nickel chloride, $NiCl_2.6H_2O$, and iron chloride, $FeCl_2.4H_2O$, were dissolved in about 100 ml of distilled water to form a reaction solution, and then filtered into a 500 ml flask. The reaction solution was degassed with argon. An argon-degassed solution of about 50 mmol of sodium borohydride, $NaBH_4$, dissolved in about 100 ml of water was then added over about a one hour period. Immediately upon addition of the sodium borohydride solution, hydrogen gas was evolved from the solution and a black, magnetic precipitate was formed. After the addition was completed, the reaction solution was stirred for about 16 hours to ensure that the reaction had gone to completion. The solution was cannulated away from the precipitate and the precipitate was then washed with two 50 ml portions of distilled water. The precipitate was then dried under a vacuum at about 60° C. for about 4 hours. In this condition, the black precipitate powder reacts vigorously upon exposure to oxygen, and so should be maintained in the absence of oxygen.

The powder was then divided into two portions and sealed in pyrex tubes under vacuum. One portion was heat-treated at about 200° C. for about 120 hours. The second portion was heat-treated to about 400° C. for about 148 hours.

X-ray diffraction data indicated that the powder that was heat-treated at 200° C. was found to comprise an amorphous material, having a composition of about $Fe_2Ni_2B$. The data also indicated that this amorphous metal alloy material possessed an effective microcrystalline size of about 12 Angstroms and an average interatomic distance of about 1.35 Angstroms. Differential scanning calorimetry was implemented to determine that the amorphous powder material possessed a glass transition temperature of about 330° C. and a crystallization temperature of about 400° C.

X-ray diffraction data performed for that portion which was heat-treated at about 400° C. indicated that this material was crystalline.

EXAMPLE 2

The procedure described above in Example 1 could be repeated with the exception that the precursor compounds used to form the amorphous iron-nickel-boron composition need not be iron chloride and nickel chloride, but instead may be iron sulfate, $FeSO_4.7H_2O$, and nickel bromide, $NiBr_2.6H_2O$. Following the same procedure as Example 1, these precursor compounds may be used to produce a substantially amorphous metal alloy of approximate composition $Fe_2Ni_2B$.

EXAMPLE 3

This example illustrates the novel process of this invention with the formation of an amorphous metal alloy of iron-nickel-boron and also describes the formation of crystalline powders of iron and nickel boride About 10 mmol of nickel chloride were dissolved in about 100 ml of distilled water, filtered and degassed with argon. An argon-degassed solution of sodium borohydride was then added dropwise to produce a precipitate that comprised nickel boride. The solution was stirred for about 16 hours to ensure that the reaction had gone to completion. The precipitate was dried at about 60° C. under a vacuum for about 4 hours.

About 10 mmol of iron chloride were dissolved in about 100 ml of distilled water, filtered and degassed with argon. An argon-degassed solution of sodium borohydride was then added dropwise to produce a precipitate that comprised elemental iron. This solution was stirred for about 16 hours to ensure that the reaction had gone to completion. The precipitate was then dried at about 60° C. under a vacuum for about 4 hours.

Portions of the two precipitates, one comprising $Ni_2B$ and one comprising elemental iron were each separately sealed under vacuum in reaction vessels. About equal portions of the two precipitates were also mixed together physically with a mortar and pestle and sealed in a reaction vessel under vacuum. All of the reaction vessels were then heated at about 200° C. for about 120 hours.

X-ray diffraction data was obtained on the individual reduction products and on the material from each of the three reaction vessels. This data indicated that the iron powder and nickel boride that were produced by the chemical reduction of precursor compounds were amorphous; this being an indication of the fineness of the particles produced by the reduction reaction. X-ray diffraction data also showed that these iron and nickel-boride powders, when heated separately under the above-described conditions, form the crystalline phase of the material. However, an intimate mixture of iron and nickel-boride produces an amorphous alloy of iron-nickel-boron when treated in the manner described above.

The formation of the amorphous metal alloy of iron-nickel-boron which resulted from the separate reduction of nickel-chloride and iron-chloride, followed by physical mixing is attributed to the small particle size of these materials which results from the chemical reduction process. The maximum particle size of these materials is on the order of from about 10 Angstroms to about 1,000 Angstroms. It is expected that a mixture of commercially available elemental iron and nickel-boride powders, not having a very small particle size would produce a predominantly crystalline material.

EXAMPLE 4

This Example demonstrates the formation of an amorphous iron-palladium-nickel-boron composition. The following three precursor metal-bearing compounds were used for this synthesis; iron chloride, $FeCl_2.4H_2O$; potassium palladium chloride, $K_2PdCl_4$, and nickel chloride, $NiCl_2.6H_2O$. About 15 mmol of potassium chloride, KCl, and about 5 mmol of palladium chloride, $PdCl_2$, were dissolved in about 100 ml of distilled water. This solution was stirred and heated to about 80° C. to obtain a homogeneous solution of potassium palladium chloride, $K_2PdCl_4$. To this solution was added about 5 mmol of iron chloride and 10 mmol of nickel chloride. This solution, now containing the precursor compounds, was filtered. The solution was then degassed with argon, whereafter an argon-degassed solution of about 50 mmols of sodium borohydride, $NaBH_4$, dissolved in about 100 ml of water was added over a period of about 1 hour.

With the addition of sodium borohydride, hydrogen gas was evolved and a black, magnetic precipitate was formed. After the addition was completed, the reaction solution was stirred for about 16 hours under an argon atmosphere to ensure that the reaction had gone to completion. The precipitate which was formed was recovered, washed with distilled water, and dried under vacuum at about 60° C. for about 4 hours. This resultant black powder was then heat-treated under vacuum at about 200° C. for about 168 hours.

The solid, powder material that was recovered after heat-treating was subjected to x-ray diffraction analysis and determined to be an amorphous iron-palladium-nickel-boron alloy of approximate composition $FePdNi_2B$.

EXAMPLE 5

This Example demonstrates the formation of an amorphous cobalt-iron-boride composition.

Precursor materials, cobalt chloride, $CoCl_2.6H_2O$, and iron chloride, $FeCl_2.4H_2O$, were disposed in a solution of distilled water in a molar ratio of about 2:3. This solution was degassed with argon after which an argon-degassed solution of sodium borohydride was added dropwise over a period of about one hour. With the addition of the sodium borohydride solution, a precipitate was formed. The precipitate was recovered, washed with distilled water and dried under vacuum at about 60° C. After drying the precipitate was transferred into a sealed pyrex tube and heated under vacuum at about 200° C. for about 168 hours. The powder that was recovered after heat-treating was subjected to x-ray diffraction analysis and determined to be an amorphous cobalt-iron-boron alloy of approximate composition $Co_2Fe_3B$.

EXAMPLE 6

The formation of an amorphous cobalt-iron-nickel-boron composition is described in this Example.

The following three precursor compounds may be disposed in an aqueous solution in the following molar ratios: about 10 mmols of cobalt tetrafluoroborate, $Co(BF_4)_2.6H_2O$; about 10 mmols nickel chloride, $NiCl_2.6H_2O$; and about 20 mmols of iron sulfate, $FeSO_4.7H_2O$. The solution may then be degassed, as with argon, nitrogen or an inert gas, to effectively remove oxygen therefrom. To this solution may then be added dropwise a degassed solution of sodium borohydride. With the addition of sodium borohydride solution, a precipitate would form. The precipitate may be recovered, washed with distilled water and dried under vacuum at about 60° C. This material may next be heat-treated at about 200° C. for about 120 hours. The resultant solid, powder material that would be obtained by this reduction, heat-treating process, when subjected to x-ray diffraction, would be seen to be an amorphous cobalt-iron-nickel-boron alloy. The approximate composition of this amorphous alloy would be about $CoFe_2NiB_2$.

EXAMPLE 7

This example demonstrates the synthesis of an amorphous iron-nickel-boron alloy derived from the chemical reduction of elements in a micellular solution.

About equimolar amounts of 10 mmol each of iron chloride and nickel chloride were disposed in about 100 ml of distilled water to form a solution. To this solution was added about 750 grams of n-hexanol and 150 grams of hexadecyltrimethylammonium bromide (CTAB). This solution was stirred and degassed with argon. About 50 mmol of sodium borohydride in about 10 ml of distilled, degassed water was added dropwise over about a one hour period. The solution was stirred for about 16 hours. The solution was allowed to settle whereupon two distinct phases were seen, a top, clear solution and a bottom, oil-like phase containing solid precipitate.

The phase containing the precipitate was washed with first distilled water and then with ethanol, then dried under vacuum at about 60° C. for about 3 hours.

A black powder was recovered. Scanning transmission electron microscopy was used to examine the dried powder material, which was an intimate mixture of iron, nickel and boron. This material was shown to have a maximum particle size of between about 50 Angstroms and about 100 Angstroms.

The intimate mixture of iron, nickel and boron could thereafter be made amorphous by heat-treating, such as heating under an argon atmosphere at about 200° C. for about 120 hours. Such heating would produce an amorphous metal alloy of approximate composition $Fe_2Ni_2B$.

The above-described examples demonstrate the formation of amorphous metal alloy compositions by chemical reduction of precursor materials and, when needed, followed by heat-treating. The formation of such amorphous materials could only be obtained previously with the use of high temperature, energy intensive processes. The novel processes described herein produce amorphous metal alloy powders, whereas prior art processes yield amorphous materials only in solid, thin-film or ribbon-like forms which must be physically reduced to powders if they are to be formed into solid shapes. In addition, novel amorphous metal alloys may be synthesized in accordance with the processes disclosed herein which have not been synthesized by other means.

The selection of precursor materials, reducing agent, heat-treating temperatures and other reactant conditions can be determined from the preceeding Specification without departing from the spirit of the invention herein disclosed and decribed. The scope of the invention is intended to include modifications and variations that fall within the scope of the appended claims.

We claim:

1. A process for the synthesis of a substantially amorphous metal alloy powder comprising disposing at least one metal-bearing compound in a liquid medium and reducing the at least one metal-bearing compound so as to form a substantially amorphous metal powder.

2. The process in accordance with claim 1 wherein said powder is further processed into a solid shape.

3. A process in accordance with claim 1 wherein the amorphous metal alloy formed is at least 50 percent amorphous.

4. A process in accordance with claim 1 wherein the amorphous metal alloy formed is at least 80 percent amorphous.

5. The process in accordance with claim 1 wherein the amorphous metal alloy formed is about 100 percent amorphous.

6. The process in accordance with claim 1 wherein said process synthesizes an amorphous metal alloy composition including nonmetallic elements.

7. The process in accordance with claim 6 wherein said nonmetallic elements include boron, carbon, nitrogen, silicon, phosphorus, arsenic, germanium and antimony.

8. The process in accordance with claim 1 wherein said liquid medium is aqueous.

9. The process in accordance with claim 1 wherein said at least one metal-bearing compound is reduced in the presence of a chemical reducing agent.

10. The process in accordance with claim 9 wherein said chemical reducing agent is a compound selected from the group comprising hydrogen, hydrazine, hydroxyl amines, alkali borohydrides, alkali-hydrogen-phosphites and alkali hypophosphites.

11. The process in accordance with claim 9 wherein said chemical reducing agent is sodium borohydride.

12. The process in accordance with claim 1 wherein prior to reducing said at least one metal-bearing compound said liquid medium is degassed with nitrogen, and inert gas or a reducing gas.

13. The process in accordance with claim 1 wherein said substantially amorphous metal alloy has a maximum particle size of from about 10 Angstroms to about 1,000 Angstroms.

14. The process in accordance with claim 1 wherein said substantially amorphous metal alloy has a maximum particle size of from about 10 Angstroms to about 500 Angstroms.

15. A process for the synthesis of a substantially amorphous metal alloy comprising the steps of:

(a) disposing at least one metal-bearing compound in a liquid medium;

(b) reducing said at least one metal-bearing compound so as to obtain an intimate mixture of the component of the amorphous metal alloy to be synthesized; and (c) heat-treating said intimate mixture so as to form the substantially amorphous metal alloy.

16. The process in accordance with claim 15 wherein said substantially amorphous metal alloy is synthesized as a powder.

17. The process in accordance with claim 15 wherein prior to step (c) said intimate mixture of the components of the amorphous metal alloy to be synthesized is pressed into a shape.

18. The process in accordance with claim 15 wherein said substantially amorphous metal alloy of step (c) is formed into a solid shape.

19. The process in accordance with claim 15 wherein said substantially amorphous metal alloy is at least 50 percent amorphous.

20. The process in accordance with claim 15 wherein said substantially amorphous metal alloy is at least 80 percent amorphous.

21. The process in accordance with claim 15 wherein said substantially amorphous metal alloy is about 100 percent amorphous.

22. The process in accordance with claim 15 wherein said process synthesizes an amorphous metal alloy composition including nonmetallic elements.

23. The process in accordance with claim 22 wherein said nonmetallic elements include boron, carbon, nitrogen, silicon, phosphorus, arsenic, germanium and antimony.

24. The process in accordance with claim 15 wherein said liquid medium is aqueous.

25. The process in accordance with claim 15 wherein said reducing of the at least one metal-bearing compound occurs with a chemical reducing agent.

26. The process in accordance with claim 25 wherein said chemical reducing agent is selected from the group comprising hydrogen, hydrazine and sodium borohydride.

27. The process in accordance with claim 25 wherein said chemical reducing agent is sodium borohydride.

28. The process in accordance with claim 15 wherein prior to reducing the at least one metal-bearing compound said liquid medium is degased with nitrogen, an inert gas or a reducing gas.

29. The process in accordance with claim 15 wherein said intimate mixture is maintained in an oxygen-free atmosphere.

30. The process in accordance with claim 15 wherein said intimate mixture is heat-treated in a vacuum.

31. The process in accordance with claim 15 wherein said heat-treating is performed at a temperature below the crystallization temperature of the amorphous alloy to be formed.

32. The process in accordance with claim 15 wherein said substantially amorphous metal alloy has a maximum particle size of from about 10 Angstroms to about 1,000 Angstroms.

33. The process in accordance with claim 1 wherein said substantially amorphous metal alloy has a maximum particle size of from about 10 Angstroms to about 500 Angstroms.

34. A substantially amorphous metal alloy powder synthesized by disposing at least one metal-bearing compound in a liquid medium, reducing the at least one metal-bearing compound so as to form an intimate mixture of the alloy components, and heat-treating said intimate mixture to form the amorphous metal alloy.

35. The substantially amorphous metal alloy powder in accordance with claim 34 wherein said amorphous metal alloy powder is at least 50 percent amorphous.

36. The substantially amorphous metal alloy powder in accordance with claim 34 wherein said amorphous metal alloy powder is at least 80 percent amorphous.

37. The substantially amorphous metal alloy powder in accordance with claim 34 wherein said amorphous metal alloy powder is about 100 percent amorphous.

38. The substantially amorphous metal alloy powder in accordance with claim 34 wherein the amorphous metal alloy composition includes nonmetallic elements.

39. The substantially amorphous metal alloy powder in accordance with claim 34 wherein the amorphous metal alloy composition includes nonmetallic elements selected from the group comprising boron, carbon, nitrogen, silicon, phosphorus, arsenic, germanium and antimony.

40. The substantially amorphous metal alloy powder in accordance with claim 34 wherein said powder has a maximum particle size of from about 10 Angstroms to about 1,000 Angstroms.

41. The substantially amorphous metal alloy powder in accordance with claim 34 wherein said powder has a maximum particle size of from about 10 Angstroms to about 500 Angstroms.

* * * * *